United States Patent [19]

Reid, deceased

[11] 4,182,225

[45] Jan. 8, 1980

[54] APPARATUS FOR PRODUCING FIBER CANS

[75] Inventor: Francis R. Reid, deceased, late of Minneapolis, Minn., by Joan C. Reid, administrator

[73] Assignee: The Pillsbury Company, Minneapolis, Minn.

[21] Appl. No.: 878,213

[22] Filed: Feb. 16, 1978

Related U.S. Application Data

[62] Division of Ser. No. 701,315, Jun. 30, 1976, Pat. No. 4,100,846.

[51] Int. Cl.[2] ..... B31C 3/00; B26D 1/56

[52] U.S. Cl. ..... 93/80; 83/326; 156/426

[58] Field of Search ..... 93/80, 77 R; 83/326, 83/341, 353; 206/606; 156/425, 426

[56] References Cited

U.S. PATENT DOCUMENTS

| | | | |
|---|---|---|---|
| 3,093,293 | 6/1963 | Freese | 206/606 |
| 3,630,126 | 12/1971 | Ronai | 93/80 |
| 3,756,128 | 9/1973 | Armstrong et al. | 93/80 |
| 3,765,292 | 10/1973 | Fujiwara | 83/353 X |

FOREIGN PATENT DOCUMENTS

| | | | |
|---|---|---|---|
| 1144912 | 3/1963 | Fed. Rep. of Germany | 156/426 |

*Primary Examiner*—James F. Coan

*Attorney, Agent, or Firm*—Mart C. Matthews; Michael D. Ellwein; Robert J. Lewis

[57] ABSTRACT

A can is provided that includes a tubular can body having a separation line extending from one end to the other with a label over it to prevent the separation line from opening during shipment or storage. The label includes a partial circumferential collar cut extending from one edge of the label material toward the other edge and having a termination point spaced from the other edge of the label. According to one method of manufacture the cuts in the label are formed by severing the label stock just before it is wound upon the fiber body during the manufacture of the tube from which can length pieces are cut. The knife is moved rectilinearly parallel to the tube with the same component of velocity that the label has parallel to the axis of the tube thereby providing a cut in the label at right angles to the can axis.

10 Claims, 10 Drawing Figures

22
20
22
20
12
14
24
16

22
26
12
14
24
18

22
18
12
14
26
16

30
22
28
18
26
7

7
30
28
32
26
20
12
16
10
34

30
22
28
16
18
22
26
26 b
7
18
16
26a
7

APPARATUS FOR PRODUCING FIBER CANS

This is a division of application Ser. No. 701,315 filed June 30, 1976, now U.S. Pat. No. 4,100,846.

FIELD OF THE INVENTION

The invention relates to the packaging industry and more particularly to an apparatus for manufacturing fiber cans.

THE PRIOR ART

U.S. Pat. Nos. 2,793,126; 2,793,127; 3,144,193 and 3,940,496 describe fiber cans used in the packaging of food products such as refrigerated dough which must be removed from the can through an opening extending from one end of the can to the other. These cans include a fiber body having a line of weakness i.e., a separation line which extends the length of the can through which the dough products can be removed when the can is opened. The separation line is held shut at least in part by the label which overlies the separation line. In the last mentioned patent a reinforcing tape is also used to hold the separation line in tact until removed. In all of these patents a circumferentially extending cut is made through the label to provide a tab which can be lifted manually for removing the label in the first stage of opening the can. In the past, this cut has been produced by rotating the can on its own axis while forcing a knife against the exterior of the can body. This operation is illustrated for example in U.S. Pat. No. 3,756,128. It will be noticed that the collar cut is made in the completed tube after the label has been applied. The collar cutting knife must cut the label completely and extend slightly into the body wall of the container in order to make sure that no portion of the label remains unsevered which could cause the label to rip erratically as it is removed. The cut in the fiber body beneath the label weakens the can slightly and it has now been discovered that the can wall is usually reduced in thickness by about 0.005 to 0.008 inches. Thus, for example, a can of 0.026 inch fiber stock will be reduced to about 0.021 or 0.018 inches in thickness along the line where the collar cut is made. Moreover, a slight buldge occurs where the cut is made when the dough filled cans are stored over extended periods of time. This can rupture the seal in the can liner beneath the collar cut causing the can to leak. In addition, the edge of the label adjacent to the collar cut sometimes becomes glued down to the underlying fiber body wall. Equipment for performing the collar cutting operation has also been expensive since one collar cutting unit is required for each of the cans simultaneously cut from the tube stock.

OBJECTS

The major objects of the invention are to provide an improved dough can as well as a method and apparatus for manufacturing them wherein (a) the can is stronger but includes a reliable collar cut of the general nature previously employed, (b) provides a can which is less expensive than a corresponding can having a conventional collar cut, (c) provides a fiber dough can for foods such as dough products with a collar cut wherein the fiber body stock of the can is not cut, (d) has the ability to open reliably without the label tearing erratically, (e) provision for making a flying cut in the label stock material in synchronization with the winding of the can tube, (f) provision for preventing the collar cut from spiraling which if it occurred could interfere with the reliable opening of the can, (g) prevention of a condition in which the cut through the label does not penetrate the label completely or where the edge of the paper label stock adjacent the collar cut becomes accidentally glued down to the underlying body stock material, (h) provision for simplifying production equipment by eliminating several collar cutting units for each can line and replacing them with a single unit which cuts all label material.

THE FIGURES

FIG. 1 is a plan view of an apparatus for forming cans in accordance with one form of the invention.

SUMMARY OF THE INVENTION

Figure 7:
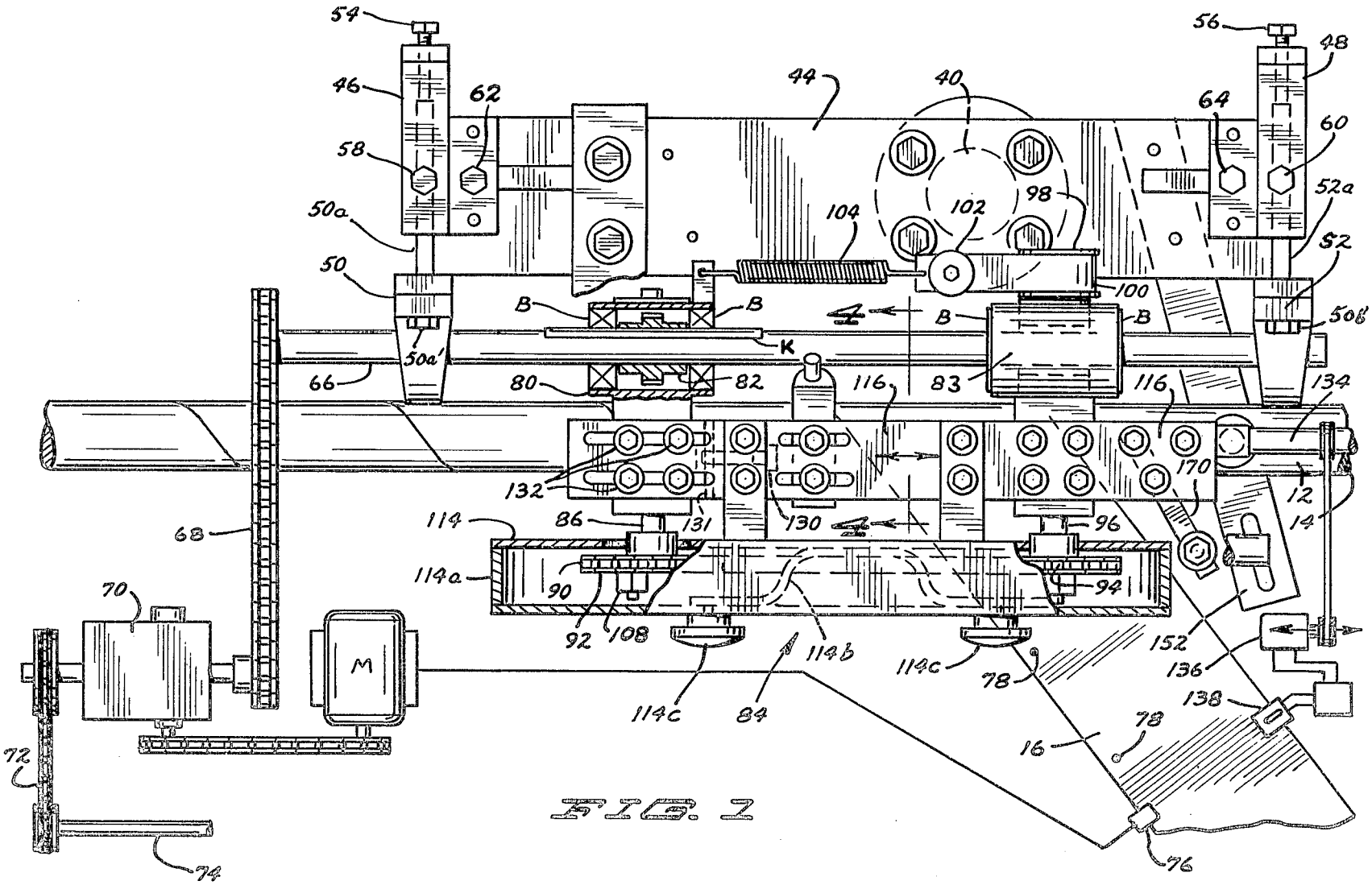
FIG. 7 is a view of the next stage of cutting.

A can is provided for foods such as dough that includes a tubular can body formed from a body strip having a separation line extending from one end to the other with a label strip or sheet thereover and preferably glued to the body strip on either side thereof to prevent the separation line from opening during shipment and storage. The label includes a partial circumferential collar cut extending across the label material to define a line along which the label separates allowing a portion of the label to be removed when one edge is lifted and pulled back. The collar cut extends from one edge of the label or near one edge toward the other edge. In one form of the invention it terminates at a point spaced from the other edge of the label.

During manufacture, the body strip and label strip are wound continuously onto an elongated mandrel with the label stock over the body stock. The partial collar cuts in the label are formed by severing the label stock before it is wound upon the fiber body during the manufacture of the tube from which the cans are cut. A knife or other label severing means is used to cut or perforate the label stock either prior to and separate from tube formation or immediately prior to wrapping the label onto the can body. The collar cut can comprise one or more cuts or perforations but does not sever the label stock completely.

In accordance with one preferred form of the invention the collar cuts are formed by making a flying cut in the label stock material. The flying cut is formed by providing a cutting knife and a means for moving the cutting knife into contact with the label stock just prior to wrapping the label stock helically around the freshly formed container tube stock during formation of the tube from which can length pieces are cut. Thus, as the label is wound onto and bonded to the tube, the knife is driven rectilinearly in synchronization with the label material being wound so that a given point on the label has a velocity component parallel to the axis of the tube equal to the velocity of the knife blade along the same axis. In this way, a cut is formed at right angles to the can axis. The cut is formed only partially through the width of the label material and terminates short of the opposite edge of the label so that a ligament of uncut label stock is present to assure that the label will continue to be drawn onto the tube being formed.

The apparatus comprises a supporting framework, at least one knife blade or other sheet severing means, means for moving the knife blade rectilinearly, means for synchronizing the knife blade movement with the speed of the label stock and means for controlling the location of the starting point at which each cut is made so that each cut can be spaced at a selected distance from the can end.

In a preferred form of the invention, the cutter is mounted upon a can forming and winding apparatus of conventional known construction and is positioned relative to other parts of the equipment to cut the label just before the label is wound onto the tube. A plurality of knives are preferably provided. Each knife is supported upon a roller chain entrained over a pair of sprockets driven at an appropriate speed and direction to move the blades as described above along one run of the chain. The blades in the other run return to the starting point. The chain can be driven from the can winder preferably through a mechanical means for advancing or retarding the position of the knives relative to the position of reference indicating position marks on the web so that each cut will be made a predetermined distance from the can end or other mark on the can.

In another form of the invention the partial collar cut comprises perforations or cuts arranged end-to-end and in this case can be provided in the label stock when it is formed, printed or wound in the coils and need not be done just prior to winding it onto the can body.

DETAILED DESCRIPTION OF THE INVENTION

The finished can and one preferred method employed for producing the can is best understood by reference to FIGS. 5–9. As shown in the figures the can indicated generally by numeral 10 is cylindrical in shape and is formed by wrapping body stock strip 12 which can be formed for example from fiberous material such as chipboard or kraft paper having a crossection of about 0.010 to 0.026 inches in thickness. Body stock layer is wrapped continously onto a mandrel 14 in a conventional manner as will be understood by those skilled in the art using any commercially available tube winding equipment suitable for this purpose. Since the tube winder is entirely conventional it will not be described in further detail.

Over the fiber body stock layer 12 is helically applied a label strip 16 formed from material lighter than the body stock such as paper laminated to aluminum foil. The label has a smooth outer surface to which printed indicia such as trademarks, opening instructions and cooking directions are imprinted as seen at 18. Glue is suitably applied to the label before being bonded in place over the body stock layer 12 in any conventional well known manner. Usually but not necessarily, a separate liner ply is wrapped inside the body stock layer 12. For simplicity the liner has not been shown in the figures. If the liner is desired, any conventional well known material such as a laminate of paper and aluminum foil can be used for this purpose.

Where the side edges of the body stock abutt against one another on the mandrel 14, a line of weakness is formed in the can which serves as a separation line 20 extending substantially from one end of the can to the other enabling the can to be opened along its full length for the removal of the dough products or other foods contained in the can.

Individual cans are severed from one another along lines 22. That is to say, the tube made up of layers 12 and 16 is severed in any conventional well known manner, for example, described in U.S. Pat. No. 3,756,128 to separate the tube into can length sections.

The formation of the tube and can body thus far described is entirely conventional. The formation of the collar cut will now be described particularly with reference to FIGS. 5 through 7. As seen in the figures, a cutting means such as a knife blade 24 is inserted into the paper web 16 with the blade oriented at right angles to the mandrel 14 and tube wrapped thereover. The blade 24 is moved as the wrapping procedure takes place in the direction parallel to the mandrel 14 and tube with velocity of the velocity component of a point on the label 16 in a direction parallel to the axis of mandrel 14 and the tube thereon. In this way a partial collar cut 26 is formed in the paper label stock 16 prior to application of the paper label stock to the tube 12. In other words, the flying cut is made in the paper strip 16 at a point spaced from the tube so that the cut is present at the time the label is wrapped onto the tube. The partial collar cut extends circumferentially of the tube after completion and is oriented substantially at right angles to the axis of the mandrel end of the tube. It is to be understood that as the cut is being made, the knife must travel in the same direction with the same velocity component as the label has at right angles to the cut in label 16 in order for the paper from which the label is made not to be torn. It will be noticed that the cut 26 extends all the way to one edge of the label to form an acute angle of about 60°, defining a lifting tab T to be lifted when the label is removed in the process of opening the can. The other end of the cut 26 terminates at 28 short of the opposite edge of the sheet 16 to define a ligament 30 of uncut paper between the end 28 of the cut 26 and the opposite edge of the label stock. This ligament assures that the label stock can be wound continuously onto the body stock layer 12. The length of ligament 30 is not critical but is preferably less than 2 to 3 inches in length. Excellent results have been achieved when it is about $\frac{1}{4}$ inch long. It can be shorter if the label does not tear during winding. The ligament can be longer if a tear member such as a ribbon or string is adhered to the label and extends from tab T parallel to the collar cut around the entire can.

After the tube is completed and severed along lines 22, the resulting tubular can body sections are capped with suitable end closures such as steel discs 32 and 34 that are crimpled or otherwise affixed to the top and bottom ends of the can. The can body tube is sometimes sold by the manufacturer without either end applied but is more usually sold with the top closure 32 attached. The bottom end closure 34 is applied by the can user after the contents have been introduced.

It will be seen in accordance with the present invention that the collar cut 26 by being formed prior to wrapping the label stock material 16 onto the can body, eliminates the need for forming a collar cut after the can is complete and accordingly there is no opportunity for the fiber body stock layer 12 to be cut beneath the collar cut 26. Thus, the chances for the can to be weakened by this manner is eliminated. When the can 10 is to be opened, the tab T is lifted and the label portion below the collar cut 26 is removed. If removed entirely, the ligament 30 of uncut label material is torn manually in the removal operation. This exposes the underlying line of weakness 20 which is then opened either by striking the can against a solid object or allowing the pressure of the material in the can to separate the can on line 20 thereby allowing the contents of the can to be removed through an opening which extends from substantially one end of the can to the other.

Figures 5, 6, 7, 8, 9, 10:
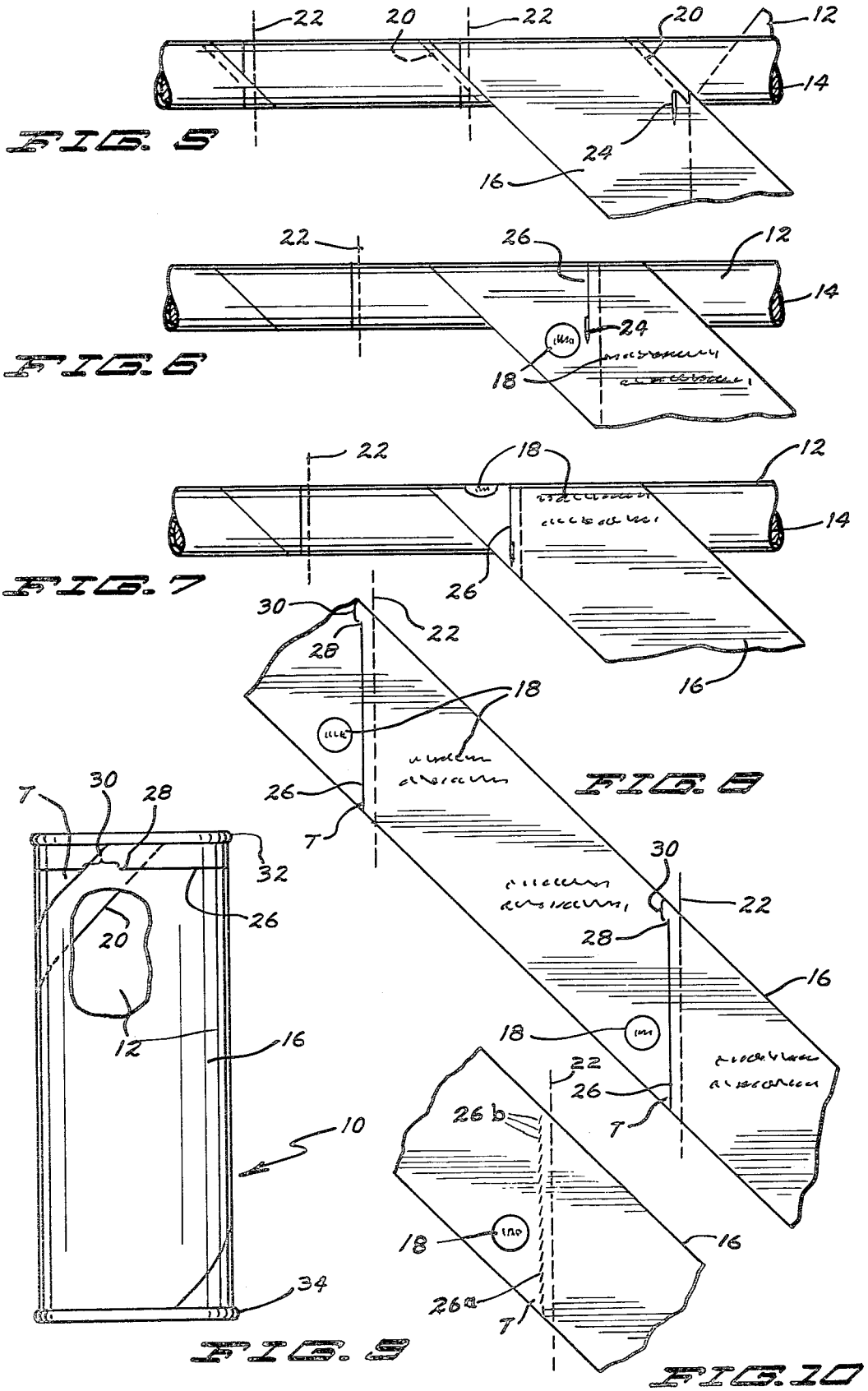
FIG. 5 is a diagramatic plan view of the label as it is cut during the first stage of the cutting operation.
FIG. 6 is a view similar to FIG. 5 during the subsequent stage of cutting.
FIG. 8 is a view of a piece of label stock which has already been cut as it appears after being unwrapped from a freshly formed tube of stock from which cans are to be cut.
FIG. 9 is a side elevational view of a finished can embodying the invention.
FIG. 10 is a view similar to FIG. 9 of a modified form of the invention.

Refer now to FIG. 10 in which the partial collar cut 26 has been replaced by a partial collar cut 26*a* composed of a plurality of short unconnected perforations or cuts 26*b* each positioned end-to-end and each oriented at an angle to the can end 22. The partial collar cut 26 extends circumferentially of the can. When tab T is pulled, the material between the cuts 26*b* tears allowing the label to be removed. The cuts 26*b* are formed in the strip 16 by any suitable well known strip perforator synchronized with the label printer. They can also be formed at any other convenient time e.g., when the strip 16 is cut from a roll or is rewound and need not be formed just before winding into tube form. Thus a conventional perforator can replace the apparatus of FIGS. 1–4. The partial collar cut 26*a* of FIG. 10 does not, however, allow removal of the label as reliably as FIGS. 5 to 9.

Refer now to FIGS. 1 to 4 which illustrates one preferred form of apparatus used for forming the collar cut in accordance with the invention.

Figure 3:
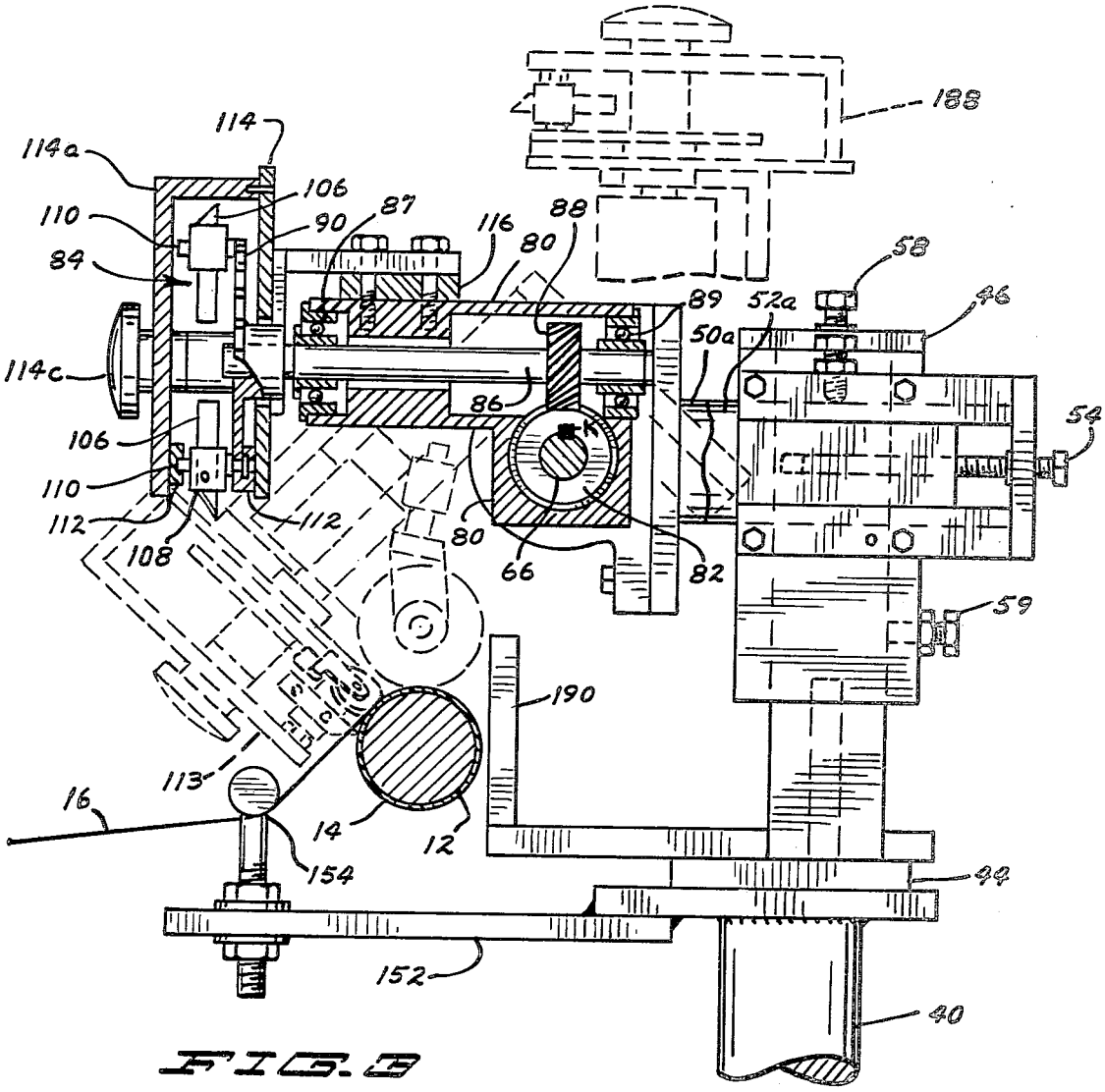
FIG. 3 is an end elevational view taken on line 3—3 of FIG. 2.
Figure 4:
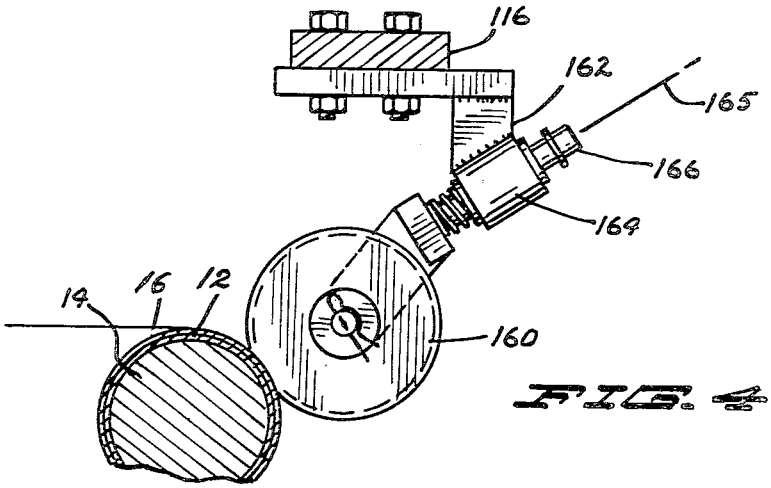
FIG. 4 is a partial transverse sectional view taken on line 4—4 of FIG. 1 on an enlarged scale turned so that the incoming web 16 is in a horizontal position.

As seen in the Figures, the apparatus includes a supporting framework made up of a supporting post 40 having a circular mounting flange 42 at its upper end to which is secured a horizontal supporting frame member such as a metal bar 44 having mounting brackets 46 and 48 at the opposite ends thereof to which are secured coaxial pillow blocks 50 and 52 respectively attached to the free ends of mounting plates 50*a* and 52*a* the latter being adjustable horizontally by means of horizontal adjustment bolt 54 and 56 respectively and locked in place by means of horizontal locking bolts 58 and 60 respectively. Vertical adjustment of the brackets and pillow blocks 50 and 52 is accomplished by means of vertical adjustment bolts 62 and 64 each locked by a vertical locking bolt 59 (only one of which is shown in FIG. 3) so that the cutting head to be described below can be precisely adjusted both vertically and horizontally to bring it into parallel alignment with the winding mandrel 14. Bolts 50*a* and 50*b* hold the blocks on the plates.

Positioned horizontally and journaled for rotation within the pillow blocks 50 and 52 is a drive shaft 66 which is powered via chain and sprocket assembly 68 that is driven from a phase shifting differential 70 which is in turn driven by a chain and sprocket assembly 72 secured to a drive shaft 74 that is connected to or itself comprises the power shaft from the can tube winding apparatus and thereby turns at the same speed and direction as the tube winder. Thus, as the tube winding drive speeds up or slows down, the drive shaft 74 and shaft 66 changes speed corespondingly and the cutting means moves at a speed proportional to the speed at which the body and label layers are wound. The relative position of shaft 66 can be advanced or retarded with respect to shaft 74 by the phase shifting differential which is most conveniently operated by a correction motor M that is controlled either manually or automatically, for example, by means of a photo eye 76 positioned adjacent the edge of the label 16 and adapted to sense position indicating reference marks 78 printed on the label. The correction motor will advance the differential 70 and shaft 66 in the event the shaft 66 driving the cutter is too late with reference to the marks 78 or retard the shaft 66 in case it is ahead of the marks 78 to thereby position each collar cut 26 at the proper location with respect to the end of the can 22 as indicated by the printing on the label strip 16 and register marks 78.

Mounted upon the shaft 66 are four bearings B, two of which support a housing 80 and two of which support a housing 83. Splined to shaft 66 by a key K and slidable thereon within housing 80 is a helicoid gear 82 which drives a knife sprocket assembly 84 through a mating gear 88 and sprocket shaft 86. Shaft 86 is supported in housing 80 upon bearings 87 and 89 and has its free end fastened to a chain sprocket 90 over which is entrained one end of chain 92. The other end of chain 92 is entrained over a sprocket 94 mounted rigidly upon a shaft 96 which is journaled for rotation in housing 83 in all respects similar to that of shaft 86 except that it is not driven, no drive gears being present. A friction drum 98 is connected to the opposite end of shaft 96. Engaged over drum 98 is a looped leather belt 100 the ends of which are connected together by means of a bolt and nut assembly 102 and fastened to a spring 104 which is connected to housing 80 for exerting a constant frictional drag on the shaft 96 to keep the lower run of chain 92 tight at all times.

Mounted on the chain 92 at uniformly spaced apart intervals equal to the length of one can 10 are a plurality of collar cutting knives 106 each supported upon a bracket 108 secured to the chain. Each bracket is provided with a horizontal extension 110 that projects laterally on both sides into grooves within horizontally extending parallel tracks 112 to thereby precisely position the blades or knives as the knives travel horizontally parallel to the mandrel 14 in the operating dotted line cutting position designated 113 of FIG. 3 which shows the cutting head as seen in end elevation. The cutting assembly and knives 106 are mounted within a housing 114 which is secured by bolts or other fasteners to a horizontal mounting bar 116. The housing 114 includes a cover 114*a* formed from transparent material such as plexiglass and is held in place by a metal brace arm 114*b* and retaining bolts 114*c*. Chain slack is taken up by a bolt 130 which projects through a flange 131 rigidly secured to and extending downwardly from bar 116 such that the end of bolt 130 strikes the right side of the housing 80 as seen in FIG. 1. After the chain tension is properly set, four bolts 132 are securely tightened to lock the housing 80 in place with respect to the bar 116. During operation, the bar 116 housings 80 and 83 and the housing 114 can be moved to the left or right on shaft 66 by means of a traverse connecting rod 134 which is itself coupled to a servo 136 controlled by means of a sensor 138 that detects the position of the edge of the label 16 and through the servo moves the rod 134 and the entire cutting assembly 84 to the left or right as seen in FIG. 1 following the edge of the label to thereby compensate for any waivering to the left or right of the label 16.

Figure 2:
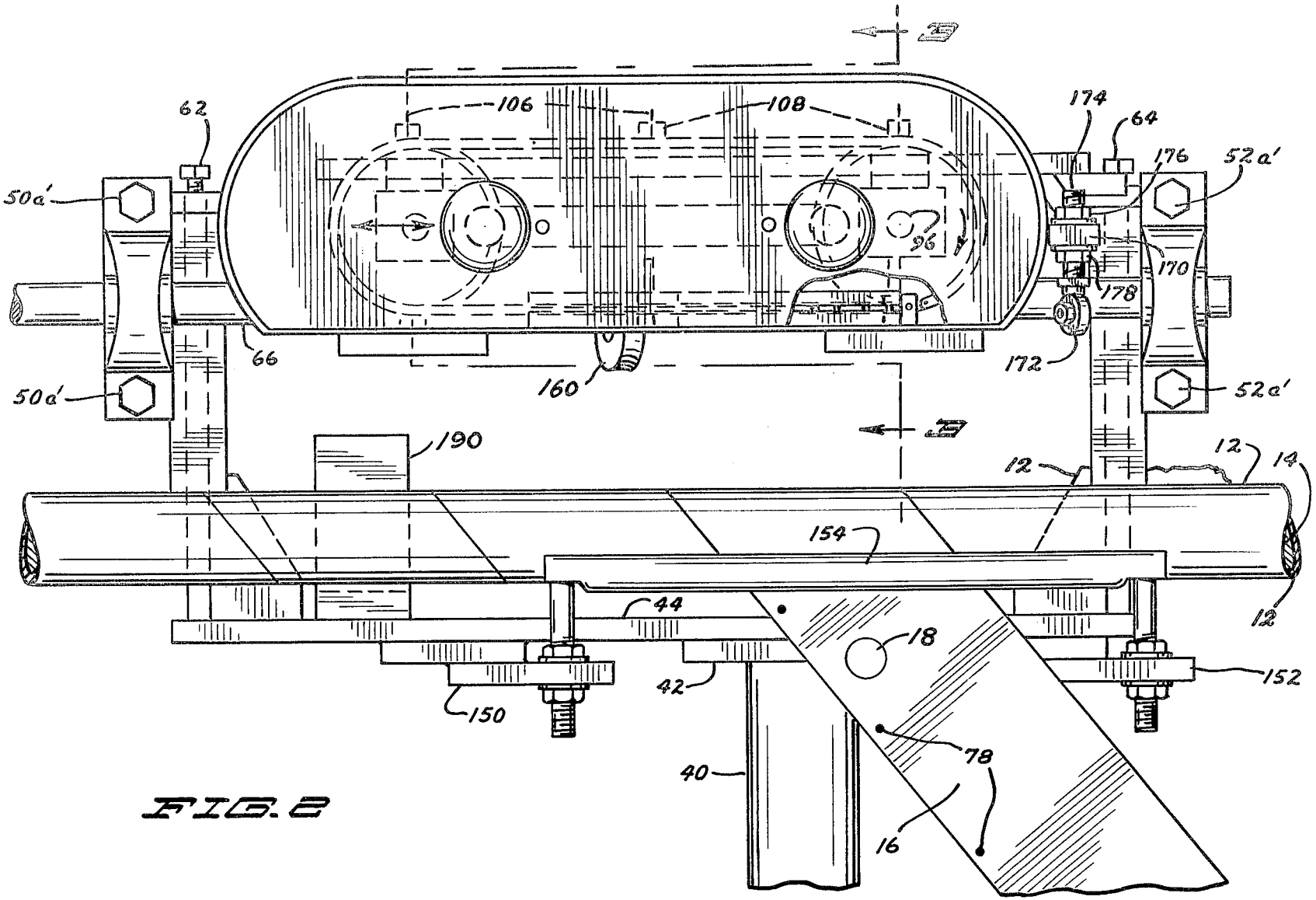
FIG. 2 is a side elevational view of the apparatus of FIG. 1 as seen from the side closest to the bottom of the sheet.

A pair of web hold down arms 150 and 152 are provided on bar 44 to support the ends of the hold down bar 154 best seen in FIG. 2 and FIG. 3. A castered wheel 160 is mounted upon a suitable bracket 162 connected to the bar 116. Wheel 160 is pivoted at 164 with its center offset from the axis 165 of its own pivot pin 166 so that it will follow the contour and align itself with the edge of label 16 as the tube is being wound. The wheel 160 is positioned in alignment over the edge of the label 16 to thereby press the edges of label 16 against the underlying fiber body stock material 12 where glue is applied to thereby securely bond the label to the body stock.

The bar 116 also has secured to it by means of a supporting bar 170 a castered wheel 172 mounted for pivotal movement upon a pivot pin 174. It rests upon the winding mandrel 14 and supports the cutting assembly when the machine is in operation. The distance that wheel 172 extends from the cutting head can be changed by penetration control adjustment nuts 176–178 to thereby accurately control the depth of penetration of knife 106 through the label material 116 while the cutting head is in the dotted line position 113 of FIG. 3.

When knives 106 are to be changed, the cutting head 84 is conveniently moved to a vertical position shown by dotted lines at 188 in FIG. 3.

A safety back up bar 190 is mounted upon the frame member 44 to help reduce damage due to blow ups (an occasional uncontrolled flying apart of the coils wound on the mandrel).

During operation, the drive shaft 74 from the tube winder imparts motion via chain and sprocket assembly 68 and 72 and phase shifting differential 70 to drive shaft 66. The phase being controlled by registration sensor 76 operating through the correction motor M which periodically either advances or retards the position of the shaft 66 with relationship to shaft 74 to keep the knives 106 cutting at the right place with respect to the location of the repeated printing pattern on the label stock 16. The rotation of shaft 66 drives the chain sprocket 90 and the chain 92 through the gears 82 and 88 at the proper speed to move the lower run of the chain 92 and the knives 106 in the same direction and with the same component of velocity in a direction parallel to the axis of the tube and label 16. When the cutting head is in position 113 each one of the knives 106 will in succession produce a collar cut in the label 16 as shown and described above in connection with FIGS. 1 through 5. Each slit terminates short of the opposite edge of the label material at 28 to provide an uncut ligament 30. The uncut ligament can be any length but is preferably not over 2 to 3 inches. Excellent results have been obtained with the ligament 30 about $\frac{3}{4}$ inches in length.

It can also be seen that frame member 116, the housings 80 and 82 and the cutting assembly 84 are pivotable as a unit about the center of the drive shaft 66 and the cutting depth control wheel 172 mounted upon the cutting assembly 84 engages the surface of the tube being wound during operation to support the cutting assembly. The nuts 176 and 178 act as selectively adjustable means for moving the cutting depth control wheel 172 upon the cutting assembly either toward or away from the mandrel 14. In this way, the engagement between the cutting depth control wheel and the tube determines the cutting depth of the knives 106.

The take up of bolt 130 allows adjustment of the chain 92 to a large range of center distances as required for cans of different lengths. Thus, for each new can length, a change in the knife spacing will be necessary. All that is necessary is to install a new chain with a different knife spacing, adjust bolt 130 to the proper chain tension and tighten the bolts 132.

What is claimed is:

1. An apparatus for forming a collar cut in a fiber can from a sheet of body stock material and a sheet of label stock material comprising a supporting framework, means for winding the body stock material and label stock material into tube form with the label on the outside of the body stock material at least one knife mounted upon the framework and adapted to be positioned to engage can label stock material just before the label stock material is wound into tube form, and drive means for the knife to move the knife rectilinearly with respect to the tube and parallel to the axis of the tube being formed at the same velocity as the velocity component of the label material in the direction of knife movement.

2. The apparatus of claim 1 wherein the knife is mounted upon a roller chain entrained over chain sprockets and the knife when located along one run the chain sprockets is engaged with the label material and the other run of the chain between the sprockets returns the knife to its starting position.

3. The apparatus of claim 2 wherein said means is a tube winder operatively connected to the tube for winding the tube and said sprocket is operatively connected to the tube winder for movement in synchronization therewith.

4. The apparatus of claim 3 wherein a phase shifting means is operatively connected between the tube winder and the sprocket for advancing or retarding the sprocket and knife with respect to the tube winder whereby the knife can be made to cut in a predetermined position with respect to the label material.

5. The apparatus of claim 4 wherein a sensor is connected to the phase shifting means and operatively associated with the label stock material to advance or retard the phase shifting means responsive to the passage of registration marks on the label stock material.

6. The apparatus of claim 1 wherein the apparatus includes a drive shaft journaled for rotation parallel to the tube, a pair of parallel horizontally spaced apart sprocket shafts mounted at substantially right angles to said drive shaft, means coupling at least one of the sprocket shafts to rotate with the drive shaft, a sprocket mounted on each of the sprocket shafts, a knife support chain entrained between the sprockets and at least one knife mounted upon the chain.

7. The apparatus of claim 6 wherein a pressing wheel is connected to the apparatus and positioned in engagement with the adjacent edges of the label stock material at the point where the label stock material is wound onto the tube.

8. The apparatus of the claim 7 wherein the label has adjacent edges and the pressing wheel is castered to follow the adjacent label edges.

9. The apparatus of claim 6 wherein the sprocket shafts are pivotable about the center of the drive shaft.

10. The apparatus of claim 6 wherein the chain is provided with a plurality of cutting knives and the distance between each cutting knife is equal to the length of the cans being formed.

* * * * *